US007950499B2

(12) United States Patent
Okamoto et al.

(10) Patent No.: US 7,950,499 B2
(45) Date of Patent: May 31, 2011

(54) CONTROL APPARATUS FOR AN ELEVATOR RESPONSIVE TO CAR-MOUNTED POSITION DETECTORS

(75) Inventors: Ken-ichi Okamoto, Tokyo (JP); Takashi Yumura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 562 days.

(21) Appl. No.: 12/094,653

(22) PCT Filed: Nov. 29, 2005

(86) PCT No.: PCT/JP2005/021869

§ 371 (c)(1),
(2), (4) Date: May 22, 2008

(87) PCT Pub. No.: WO2007/063574

PCT Pub. Date: Jun. 7, 2007

(65) Prior Publication Data

US 2009/0120729 A1 May 14, 2009

(51) Int. Cl.
*B66B 1/34* (2006.01)

(52) U.S. Cl. ..... 187/394; 187/293

(58) Field of Classification Search ..... 187/247, 187/248, 391–394, 293, 296, 297
See application file for complete search history.

(56) References Cited

U.S. PATENT DOCUMENTS

| | | | | |
|---|---|---|---|---|
| 4,849,972 | A * | 7/1989 | Hackett et al. | 370/465 |
| 4,880,082 | A * | 11/1989 | Kahkipuro et al. | 187/394 |
| 4,898,263 | A * | 2/1990 | Manske et al. | 187/247 |
| 5,023,434 | A * | 6/1991 | Lanfer et al. | 235/375 |
| 6,435,315 | B1 * | 8/2002 | Zaharia | 187/394 |
| 6,612,403 | B2 | 9/2003 | Silberhorn et al. | |
| 6,877,587 | B2 * | 4/2005 | Kunz et al. | 187/394 |
| 7,353,916 | B2 * | 4/2008 | Angst | 187/393 |
| 7,540,358 | B2 * | 6/2009 | Okamoto et al. | 187/394 |
| 7,588,127 | B2 * | 9/2009 | Shiratsuki et al. | 187/391 |
| 2004/0216320 | A1 * | 11/2004 | Birrer et al. | 33/708 |
| 2006/0289241 | A1 | 12/2006 | Okamoto et al. | |

FOREIGN PATENT DOCUMENTS

| | | | |
|---|---|---|---|
| JP | 52-35051 | A | 3/1977 |
| JP | 55-32381 | U | 3/1980 |
| JP | 62-240280 | A | 10/1987 |
| JP | 05319717 | A * | 12/1993 |
| JP | 9-124238 | A | 5/1997 |
| JP | 2001-139266 | A | 5/2001 |
| JP | 2002-241062 | A | 8/2002 |
| JP | 2002-274765 | A | 9/2002 |
| JP | 2003-118946 | A | 4/2003 |

* cited by examiner

*Primary Examiner* — Jonathan Salata
(74) *Attorney, Agent, or Firm* — Leydig, Voit & Mayer, Ltd.

(57) ABSTRACT

A control apparatus for an elevator has a support device mounted on a car, a detection device for detecting the position of the car, and a control unit for controlling operation of the elevator based on information from the detection device. The support device has a rail holding member, which is displaceable with respect to the car and is guided by a guide rail located in a hoistway in which the car moves. The detection device is located on the rail holding member.

6 Claims, 5 Drawing Sheets

CONTROL APPARATUS FOR AN ELEVATOR RESPONSIVE TO CAR-MOUNTED POSITION DETECTORS

TECHNICAL FIELD

The present invention related to a control apparatus for an elevator which detects information on a car such as, for example, the position and/or the speed of the car, etc., and controls the operation of the elevator based on the car information thus detected.

BACKGROUND ART

In the past, there has been proposed a method for recording the image of the shapes of guide rails installed in a hoistway or the image of patterns on surfaces of the guide rails by means of a CCD linear camera for the purpose of detecting the position and/or the speed of a car. The CCD linear camera is mounted on the car that moves up and down along the guide rails (see a first patent document).

First Patent Document

Japanese patent application laid-open No. 2002-274765

DISCLOSURE OF THE INVENTION

Problems to be Solved by the Invention

However, the position of the image that is recorded by the CCD linear camera can be displaced or shifted as the car is tilted or shaked due to an offset load in the car, so it becomes difficult to improve the detection accuracy of the position and/or speed of the car.

In addition, in case where the patterns on the surfaces of the guide rails change due to the wear of the surfaces of the guide rails, the adhesion of oil thereon, etc., there might also occur incorrect detection, and it becomes further difficult to achieve an improvement in the detection accuracy of the position and/or speed of the car.

The present invention is intended to obviate the problems as referred to above, and has for its object to obtain a control apparatus for an elevator which is capable of improving the detection accuracy of the position of a car.

Means for Solving the Problems

A control apparatus for an elevator according to the present invention includes: a support device that has a rail holding member which is displaceable with respect to a car being movable up and down in a hoistway and is guided by a guide rail arranged in the hoistway, the support device being mounted on the car; a detection device that is mounted on the rail holding member for detecting the position of the car; and a control unit that controls an operation of the elevator based on information from the detection device.

BEST MODE FOR CARRYING OUT THE INVENTION

Hereinafter, preferred embodiments of the present invention will be described while referring to the accompanying drawings.

Embodiment 1

Figure 1:
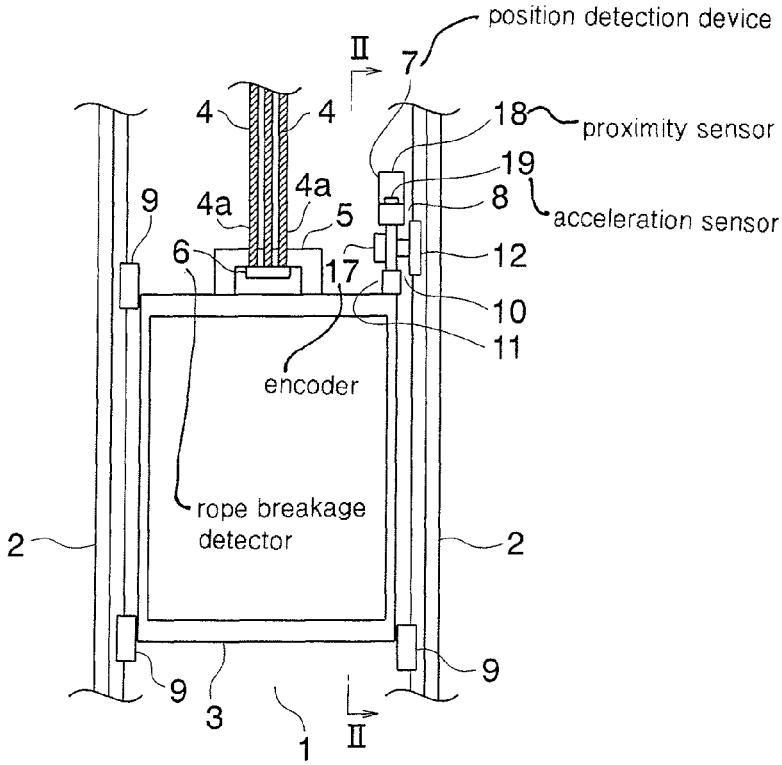
FIG. 1 is a front elevational view showing an elevator equipped with an elevator control apparatus according to a first embodiment of the present invention.

FIG. 1 is a front elevational view that shows an elevator equipped with an elevator control apparatus according to a first embodiment of the present invention.

Figure 2:
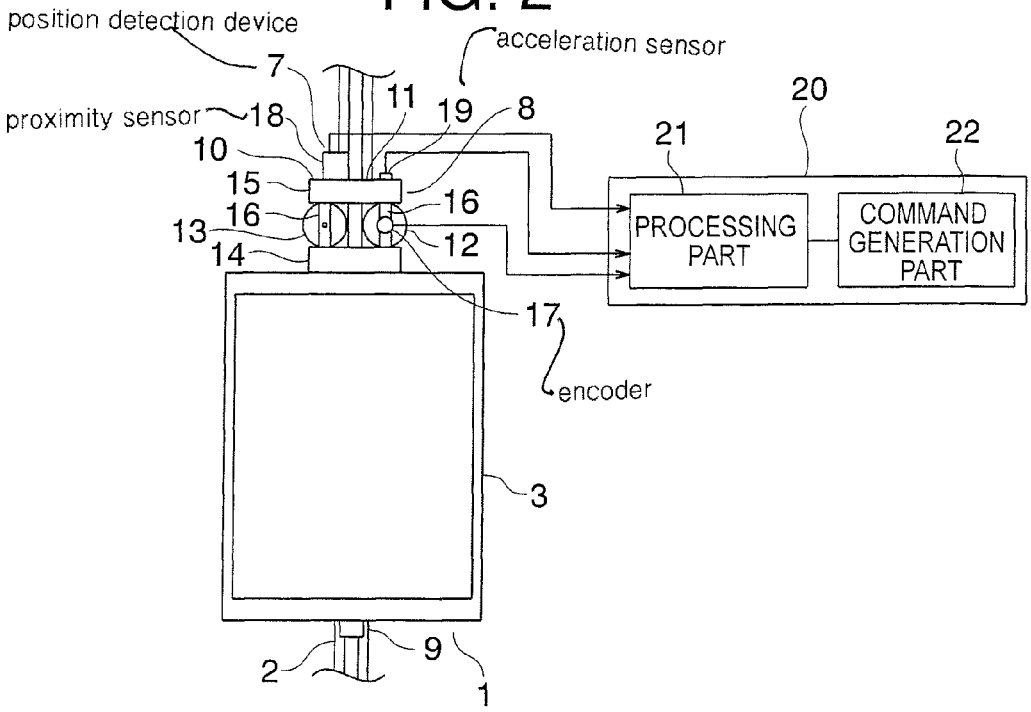
FIG. 2 is a cross sectional view along line II-II of FIG. 1.
Figure 3:
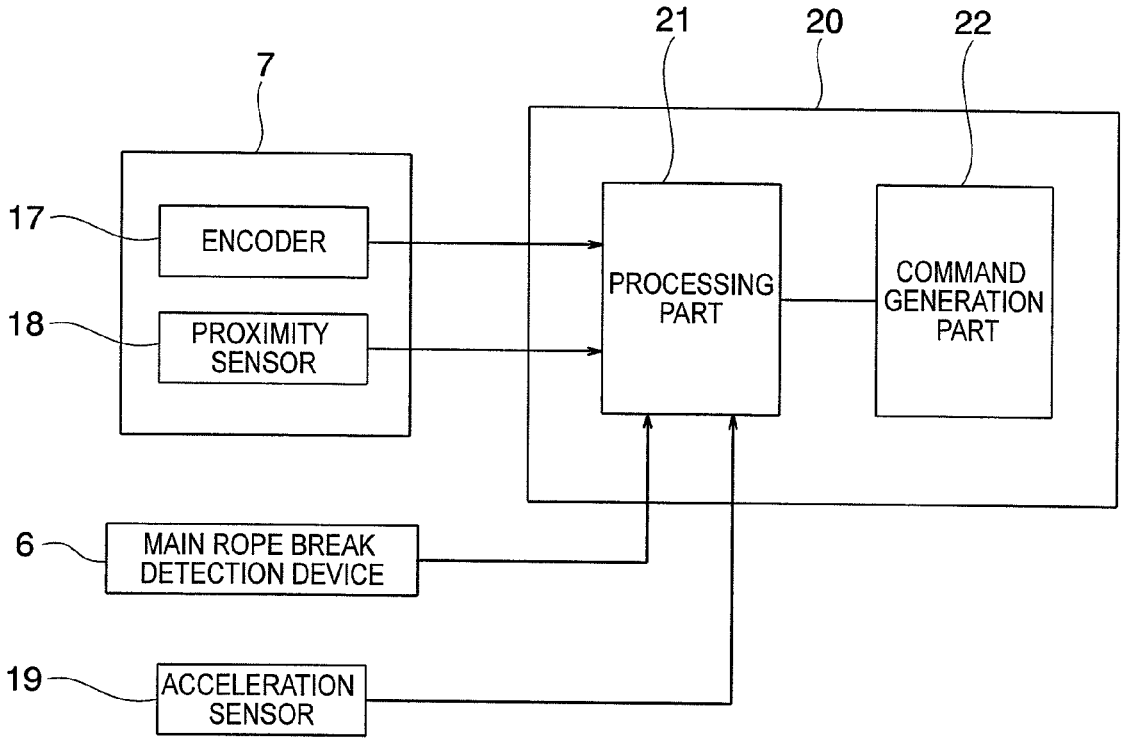
FIG. 3 is a block diagram showing the elevator control apparatus of FIG. 1.

FIG. 2 is a cross sectional view along line II-II in FIG. 1. In addition, FIG. 3 is a block diagram that shows the elevator control apparatus of FIG. 1. In these figures, a pair of car guide rails 2 and a pair of counterweight guide rails (not shown) are installed in a hoistway 1. A car 3 is disposed between the individual car guide rails 2 so as to be movable along the car guide rails 2. In addition, a counterweight (not shown) is disposed between the individual counterweight guide rails so as to be movable along the counterweight guide rails.

A winch (not shown) for driving the car 3 and the counterweight to move up and down is arranged at an upper portion of the hoistway 1. The car 3 and the counterweight are hung in the hoistway 1 by means of a plurality of main ropes 4 that are wrapped around drive sheaves of the winch. The car 2 and the counterweight are driven to move up and down in the hoistway 1 in accordance with the rotation of the drive sheaves.

A car rope fastening device 5, to which one end portion 4*a* of each of the main ropes 4 is connected, is arranged at an upper portion of the car 3. A main rope break detection device 6 for detecting the presence or absence of a break of each of the main ropes 4 is provided on the car rope fastening device 5. In this example, the presence or absence of a break of each of the main ropes 4 is detected by the magnitude of displacement of a hitch end of the corresponding main rope 4 with respect to the car rope fastening device 5.

On an upper portion of the car 3 at a side of one of the car guide rails 2, there is arranged a support device 8 that supports a detection device 7 for detecting the position of the car 3. In addition, on an upper portion and a lower portion of the car 3 at a side of the other car guide rail 2 and at opposite sides of the car guide rails 2, respectively, there are arranged guide devices 9 which are guided along the corresponding car guide rails 2 for causing the car 3 to move along the car guide rails 2. In this example, the support device 8 is mounted on the car 3 as a guide device for causing the car 3 to move along the car guide rails 2.

The support device 8 has a rail holding member 10 that is guided along the car guide rails 2. The rail holding member 10 is mounted on the car 3 in such a manner that it is able to be rotate around a horizontal axis that extends in the direction of the depth of the car 3 (i.e., in a direction perpendicular to a plane including the individual car guide rails 2). That is, the rail holding member 10 is movable or displaceable with respect to the car 3. In this example, the rail holding member 10 is mounted on the car 3 through a hinge (not shown).

The rail holding member 10 has a support member 11, and a pair of guide rollers 12, 13 that are mounted on the support member 11 and are driven to rollingly move while being in abutment with a corresponding car guide rail 2.

The support member 11 includes a lower base member 14, an upper base member 15, and a pair of roller mounting members 16 that are disposed between the lower base member 14 and the upper base member 15 with the individual guide rollers 12, 13 being mounted thereon, respectively. The lower base member 14 is mounted on the car 3 through a hinge. In addition, the individual roller mounting members 16 are urged in directions to move toward each other by means of, for example, resilient members such as springs.

The individual guide rollers 12, 13 are rotatable around a pair of rotation shafts, respectively, which are mounted on the roller mounting members 16, respectively. In this example, the individual rotation shafts are disposed in parallel with respect to each other. Between the individual guide rollers 12, there is placed a protruded portion of the corresponding car guide rail 2. The individual guide rollers 12, 13 are pressed against the protruded portion of the corresponding car guide rail 2 by the individual roller mounting members 16 being urged in the direction to move toward each other. As a result, the tilting of the rail holding member 10 with respect to the corresponding car guide rail 2 is prevented.

The detection device 7 is provided on the rail holding member 10. In addition, the detection device 7 includes an encoder (continuous position detection part) 17 for detecting the position of the car 3 in a continuous manner, and a proximity sensor (reference position detection part) 18 that is able to detect an object to be detected (not shown) which is fixedly attached to the hoistway 1 when the car 3 exists in a set reference position within the hoistway 1.

The encoder 17 is mounted on only the rotation shaft for one of the guide rollers 12. In addition, the encoder 17 generates a signal corresponding to the rotation of the one guide roller 12. The position of the car 3 is calculated based on the distance of the movement of the car 3 that is obtained by cumulatively summing a signal output from the encoder 17.

A proximity sensor 18 is mounted on the upper base member 15. The car guide rails 2 are each constructed by joining a plurality of unit rails to one another by means of bolts. Accordingly, in this example, the proximity sensor 18 serves to detect the bolts that join the unit rails to one another as objects to be detected. As objects to be detected, there are enumerated, other than the bolts, brackets for supporting the car guide rails 2, doorsills of elevator halls, etc.

In addition, an acceleration sensor (acceleration detection device) 19 for detecting the acceleration of the car 3 is provided on the rail holding member 10. In this example, the acceleration sensor 19 is mounted on the upper base member 14.

Information from each of the main rope break detection device 6, the encoder 17, the proximity sensor 18 and the acceleration sensor 19 is input to an operation control unit (control unit) 20. The operation control unit 20 controls the operation of the elevator based on the information from each of the main rope break detection device 6, the encoder 17, the proximity sensor 18 and the acceleration sensor 19.

The operation control unit 20 includes a processing part 21 that processes the information from each of the main rope break detection device 6, the encoder 17, the proximity sensor 18 and the acceleration sensor 19, and a command generation part 22 that generates a command for the operation of the elevator based on information from the processing part 21.

Information from the encoder 17 is constantly input to the processing part 21. The processing part 21 obtains the distance of the movement of the car 3 based on the information from the encoder 17, and calculates the value of the position of the car 3 based on the distance thus obtained. In addition, the value of the position of the car 3 when an object to be detected is detected by the proximity sensor 18 is beforehand stored in the processing part 21 as a value of a set reference position.

When the proximity sensor 18 detects the object to be detected, the processing part 21 determines the presence or absence of the abnormality of an elevator based on information from each of the encoder 17 and the proximity sensor 18. That is, when the proximity sensor 18 detects the object to be detected, the processing part 21 compares an encoder calculated value (a continuous detection part calculated value) calculated based on the information from the encoder 17 as a value of the position of the car 3 with the value of the set reference position corresponding to the object detected by the proximity sensor 18, makes a determination of normality when a difference between the respective values is equal to or less than a threshold which has been set beforehand, and makes a determination of abnormality when the difference between the respective values exceeds the threshold. In addition, when the determination of normality is made, the processing part 21 replaces the encoder calculated value for the value of the position of the car 3 with the value of the set reference position. The operation control unit 20 controls the operation of the elevator based on the value of the position of the car 3 after the replacement.

In addition, the processing part 21 also determines the presence or absence of the abnormality of the elevator based on information from at least either one of the main rope break detection device 6 and the acceleration sensor 19. That is, the processing part 21 makes a determination of abnormality when the main rope break detection device 6 detects that at least either one of the individual main ropes 4 has broken, or when the acceleration of the car 3 obtained by the information from the acceleration sensor 19 has come off a set allowable range. In addition, the processing part 21 makes a determination of normality when a break of any of the individual main ropes 4 is not detected, and when the acceleration of the car 3 is within the set allowable range.

The command generation part 22 outputs a control command for performing a normal time operation of the elevator to equipment of the elevator when the processing part 21 makes a determination of normality, and outputs a control command for performing an abnormal time operation of the elevator to the equipment of the elevator when the processing part 21 makes a determination of abnormality. As the abnormal time operation of the elevator, there is enumerated an operation for stopping the car 3 at the nearest floor, an operation for actuating a brake device so as to stop the rotation of a drive sheave of the winch in a forced manner, an operation for actuating an emergency stop device for stopping the fall of the car 3 in a forced manner, an operation for causing the car 3 to move to a reference floor that is set beforehand, or the like.

Now, the operation of this embodiment will be described below. When the car 3 is driven to move, the individual guide rollers 12, 13 are caused to roll on the corresponding car guide rail 2 in accordance with the movement of the car 3. As a result, a signal corresponding to the rotation of the guide roller 12 is output from the encoder 17 to the operation control unit 20.

In the operation control unit 20, the position and the speed of the car 3 are calculated based on the information from the encoder 17. After this, the operation of the elevator is controlled based on the position and the speed thus calculated of the car 3 by means of the operation control unit 20.

When the car 3 reaches the set reference position in the hoistway 1, the proximity sensor 18 detects a bolt (an object to be detected) of the corresponding car guide rail 2, so that a detection signal is output from the proximity sensor 18 to the operation control unit 20.

Figure 4:
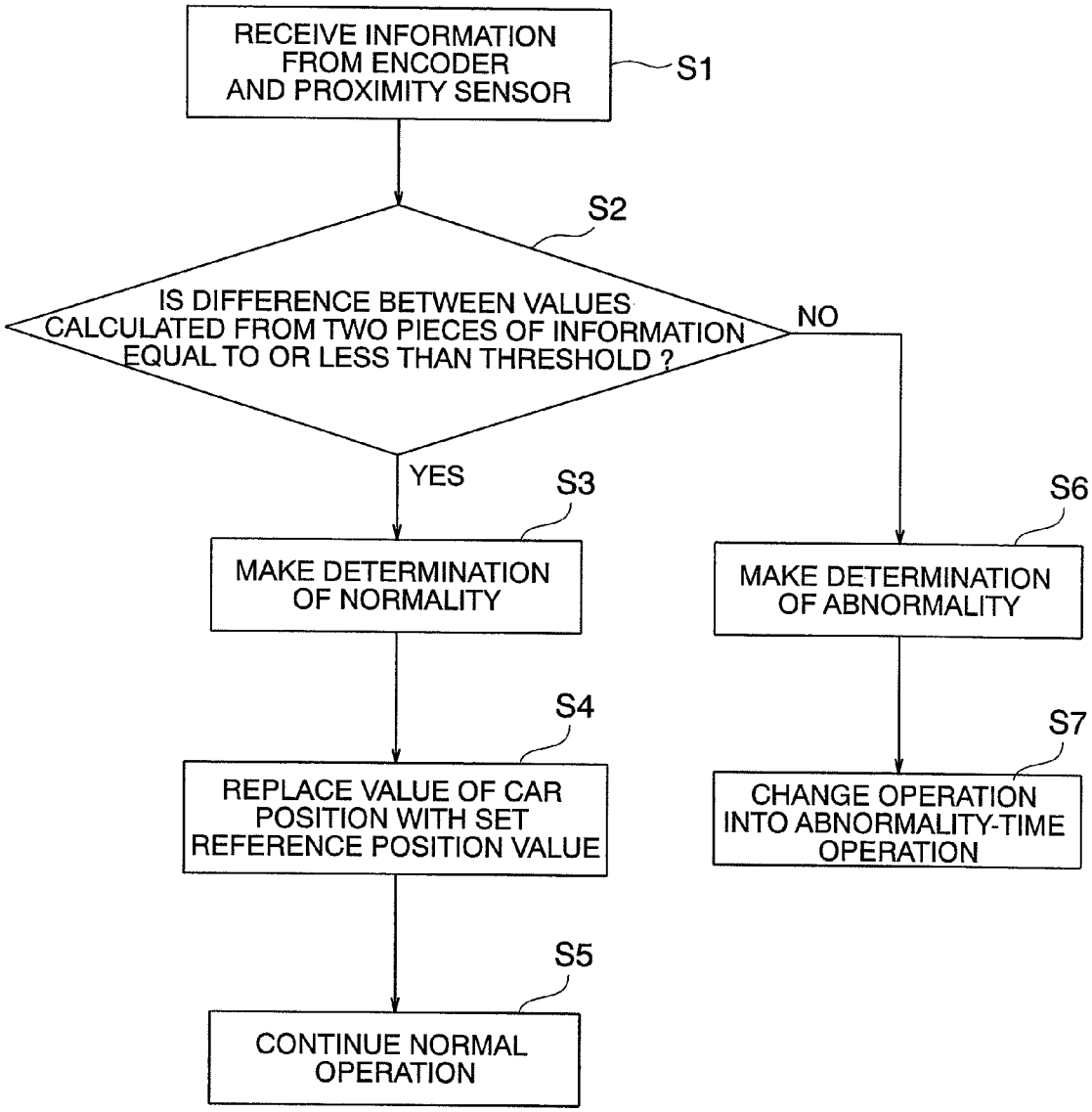
FIG. 4 is a flow chart explaining the processing operation of an operation control unit of FIG. 3.

FIG. 4 is a flow chart that explains the processing operation of the operation control unit 20 of FIG. 3. As shown in this figure, when the operation control unit 20 receives the detection signal from the proximity sensor 18 together with the information from the encoder 17 (S1), a comparison is made in the operation control unit 20 between an encoder calculated value calculated based on the information from the encoder 17 as a value of the position of the car 3 and the value of the set reference position corresponding to the object detected by the proximity sensor 18, and it is determined whether the difference therebetween is equal to or less than the threshold that has been set beforehand (S2).

When the difference is equal to or less than the threshold, a determination of normality is made by the operation control unit 20 (S3). At this time, the value of the position of the car 3 is replaced from the encoder calculated value to the value of the set reference position by the operation control unit 20 (S4). As a result, a cumulative error for the value of the position of the car 3 is eliminated. After this, the operation of the elevator is controlled based on the position of the car 3 after the replacement thereof by means of the operation control unit 20, and the normal operation of the elevator is continued (S5).

When the difference between the encoder calculated value and the value of the set reference position exceeds the threshold, a determination of abnormality is carried out by the operation control unit 20 (S6). After this, the operation of the elevator is controlled such that it is made into an operation at the time of abnormality, and for example, the elevator is operated so as to move and stop the car 3 to the nearest floor (S7).

In addition, during the time when the elevator is operating, the acceleration of the car 3 is constantly calculated based on the information from the acceleration sensor 19 by means of the operation control unit 20. When the acceleration of the car 3 is within the set allowable range, a determination of normality is carried out by the operation control unit 20, whereas when the acceleration of the car 3 is outside the set allowable range, a determination of abnormality is carried out by the operation control unit 20.

Further, when a break of any of the main ropes 4 has not been detected by the main rope break detection device 6, a determination of normality is carried out by the operation control unit 20, whereas when the break of some of the main ropes 4 is detected, a determination of abnormality is carried out by the operation control unit 20.

The operation of the elevator after the operation control unit 20 has made the determination of normality or the determination of abnormality based on the information from the main rope break detection device 6 or the acceleration sensor 19 is similar to that as mentioned above.

In such an elevator control apparatus, the support device 8 having the rail holding member 10, which is displaceable with respect to the car 3 and is guided by the corresponding car guide rail 2, is mounted on the car 3, and the detection device 7 for detecting the position of the car 3 is mounted on the rail holding member 10. With such a construction, even if the car 3 is tilted with respect to the car guide rails 2, for example, due to an offset load in the car 3, it is possible to prevent the rail holding member 10 and the detection device 7 from being tilted with respect to the car guide rails 2. Accordingly, when the detection device 7 detects an object to be detected which is fixedly attached to the corresponding car guide rail 2 for example, it is possible to reduce a deviation or displacement of the detection device 7 with respect to the object to be detected when the car 3 is tilted or when the car 3 is vibrated, thus making it possible to detect the object to be detected by means of the detection device 7 in a more reliable manner. As a result, a measurement error due to the detection device 7 can be decreased, and an improvement in the detection accuracy of the position of the car 3 can be made.

In addition, the support device 8 is used as a guide device for causing the car 3 to move along the corresponding car guide rail 2, so it is possible to prevent an increase in the installation space of the detection device 7 required.

When the proximity sensor 18 detects a bolt as an object to be detected, the operation control unit 20 determines the presence or absence of the abnormality of the elevator based on the information from each of the encoder 17 and the proximity sensor 18, so a plurality of pieces of information can be compared with one another, whereby it is possible to detect an abnormality of the elevator such as for example the failure of the encoder 17 or the like. Accordingly, it is possible to prevent the operation of the elevator from being performed based on the incorrect position of the car 3.

Moreover, when the difference between the encoder calculated value calculated based on the information from the encoder 17 as the value of the position of the car 3 and the value of the set reference position corresponding to the object detected by means of the proximity sensor 18 is equal to or less than the threshold, the operation control unit 20 replaces the value of the position of the car 3 from the encoder calculated value to the value of the set reference position. As a result, it is possible to prevent an increase in the cumulative error of the value of the position of the car 3 due to the information from the encoder 17, thereby making it possible to achieve a further improvement in the detection accuracy of the position of the car 3.

Further, the operation control unit 20 controls the operation of the elevator based on the information from the acceleration sensor 19 which serves to detect the acceleration of the car 3. Accordingly, for example, in such a case as where the car 3 falls due to a break of the main ropes 4, the acceleration of the car 3 becomes abnormal before the position or the speed of the car 3 becomes abnormal, so the abnormality of the elevator can be detected at a much earlier point in time. In addition, since the speed and the position of the car 3 can be obtained by integrating the detected acceleration of the car 3, it is possible to achieve a further improvement in the detection accuracy of the position or speed of the car 3 by comparing the position or the speed of the car 3 obtained from the acceleration of the car 3 with the position or the speed of the car 3 calculated based on the information from the encoder 17, respectively.

Furthermore, the operation control unit 20 controls the operation of the elevator based on the information from the main rope break detection device 6 which serves to detect the presence or absence of the break of the main ropes 4, so in case where the car 3 falls due to the break of the main ropes 4, it is possible to detect the abnormality of the elevator at an early point in time before the speed or acceleration of the car 3 becomes abnormal.

Embodiment 2

Figure 5:
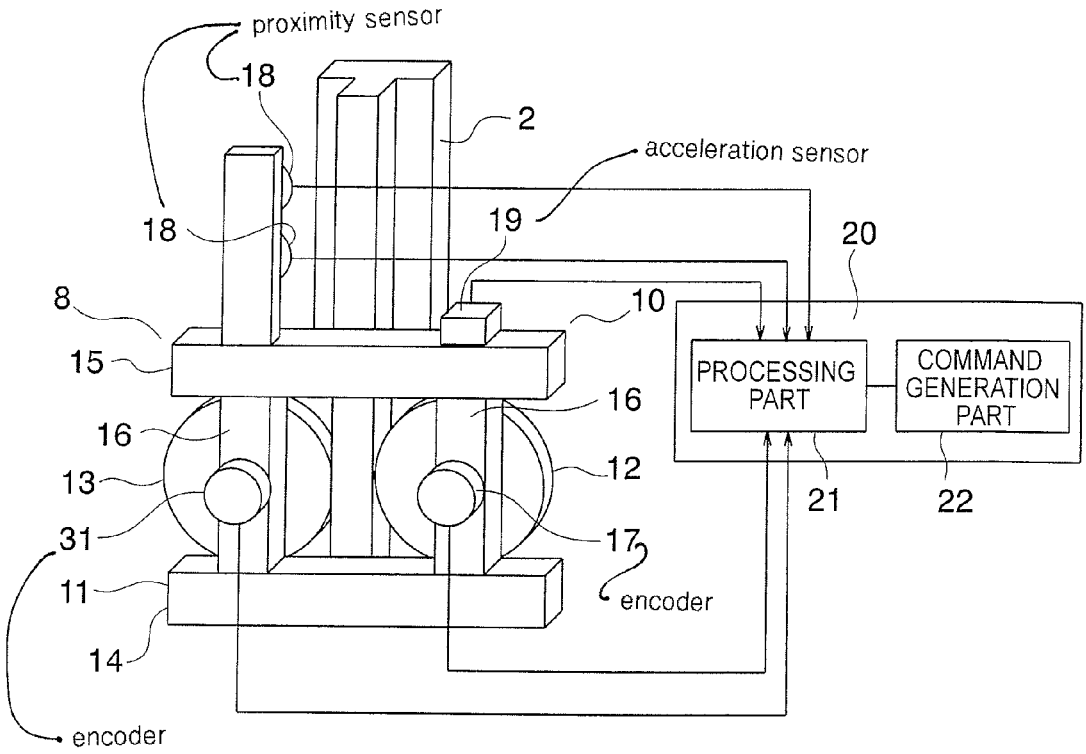
FIG. 5 is a perspective view showing a detection device and a support device in a control apparatus for an elevator according to a second embodiment of the present invention.

FIG. 5 is a perspective view that shows a detection device 7 and a support device 8 in a control apparatus for an elevator according to a second embodiment of the present invention. In this figure, the detection device 7 for detecting the position of a car 3 includes a plurality of (two in this example) encoders (continuous position detection part) 17, 31 for respectively detecting the position of the car 3 in an continuous manner, and a plurality of (two in this example) proximity sensors 18 that are arranged at a interval therebetween in a direction of movement of the car 3.

The encoder 17 is mounted on a rotation shaft for one of guide rollers 12. In addition, the encoder 17 generates a signal corresponding to the rotation of the one guide roller 12.

The encoder 31 is mounted on a rotation shaft for the other guide roller 13. In addition, the encoder 31 generates a signal corresponding to the rotation of the other guide roller 13.

One proximity sensor 18 of the individual proximity sensors 18 detects an object to be detected when the car 3 exists in a set reference position within the hoistway 1. The other proximity sensor 18 is an auxiliary proximity sensor for detecting an object to be detected when the car 3 is deviated or displaced from the set reference position.

Information from each of the encoders 17, 31, the individual proximity sensors 18, an acceleration sensor 19 and a main rope break detection device 6 is input to an operation control unit 20. Information from each of the encoders 17, 31 is constantly input to a processing part 21. The processing part 21 obtains the distances of the movement of the car 3 based on the individual pieces of information from the encoders 17, 31, respectively, and calculates the values (two values) of the position of the car 3 based on the individual distances thus obtained, respectively.

In addition, the processing part 21 determines the presence or absence of the abnormality of the elevator by making a comparison between the two encoder calculated values which have been obtained as the values of the position of the car 3 based on the information from the individual encoders 17, 31. That is, the processing part 21 makes a determination of normality when a difference between the individual encoder calculated values thus obtained is equal to or less than a threshold which has been set beforehand, and makes a determination of abnormality when the difference therebetween exceeds the threshold. In addition, when the determination of normality is made, the processing part 21 replaces the value of the position of the car 3 with an average value of the individual encoder calculated values. The operation control unit controls the operation of the elevator based on the value of the position of the car 3 after the replacement. The construction of this embodiment other than the above is similar to that of the first embodiment.

Figure 6:
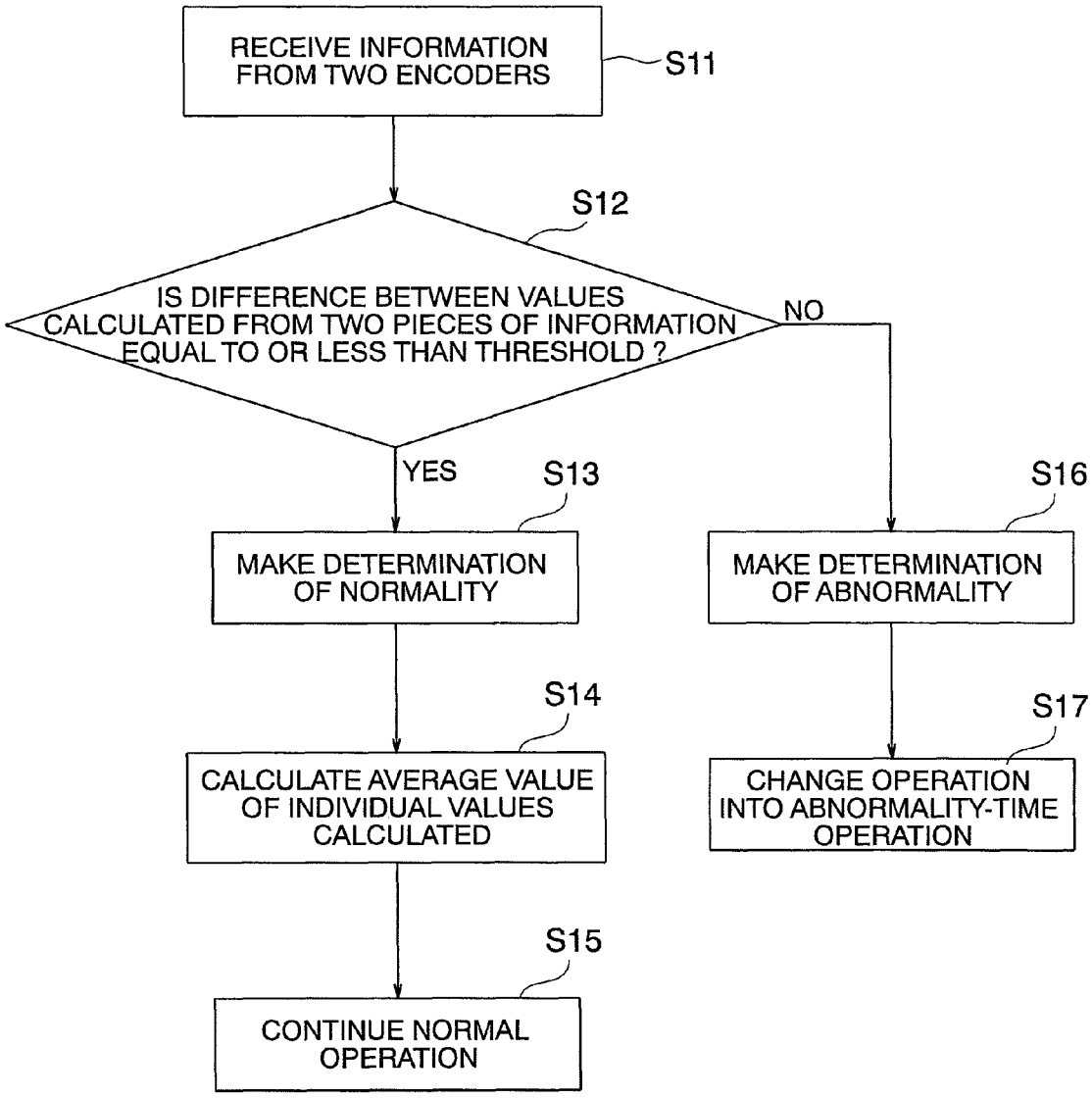
FIG. 6 is a flow chart for explaining the processing operation of an operation control unit of FIG. 5.

Now, the operation of this embodiment will be described below. FIG. 6 is a flow chart for explaining the processing operation of the operation control unit 20 of FIG. 5. As shown in this figure, when the individual guide rollers 12, 13 are caused to roll on a corresponding car guide rail 2 as the car 3 is driven to move, a signal corresponding to the rotation of the one guide roller 12 is output from the encoder 17, and a signal corresponding to the rotation of the other guide roller 13 is output from the encoder 31, to the operation control unit 20, respectively (S11).

After this, in the operation control unit 20, the encoder calculated values are calculated based on the pieces of information from the individual encoders 17, 31 as the values of the position of the car 3, respectively, and it is determined whether the difference between the encoder calculated values thus obtained is equal to or less than the threshold that has been set beforehand (S12).

When the difference is equal to or less than the threshold, a determination of normality is made by the operation control unit 20 (S13). At this time, the average value of the individual encoder calculated values is obtained by the operation control unit 20 (S14). After this, the average value thus obtained is replaced to the value of the position of the car 3, and the operation of the elevator is controlled based on the position of the car 3 after the replacement thereof by means of the operation control unit 20, whereby the normal operation of the elevator is continued (S15).

When the difference between the individual encoder calculated values exceeds the threshold, a determination of abnormality is carried out by the operation control unit 20 (S16). After this, the operation of the elevator is controlled by the operation control unit 20 such that it is made into an operation at the time of abnormality, and for example, the elevator is operated so as to move and stop the car 3 to the nearest floor (S17). The operation of this second embodiment other than the above is similar to that of the first embodiment.

In such a control apparatus for an elevator, the presence or absence of the abnormality of the elevator is determined based on the pieces of information from the individual encoders 17, 31. As a result, the plurality of pieces of information can be compared with one another, whereby it is possible to detect an abnormality of the elevator such as for example the failure of the one encoder 17 or the like. Accordingly, it is possible to prevent the operation of the elevator from being performed based on the incorrect position of the car 3.

In the above example, when the operation control unit 20 makes a determination of normality, the operation of the elevator is controlled based on the average value of the two encoder calculated values which are calculated by the information from the individual encoders 17, 31, but the operation of the elevator can be controlled based on either one of the two encoder calculated values thus obtained.

In addition, in the above-mentioned respective embodiments, only one support device 8 is provided on the car 3, but a plurality of support devices 8 can instead be provided on the car 3. In this case, the detection device 7 is provided on the rail holding member 10 of each of the support devices 8. Also, the operation control unit 20 controls the operation of the elevator based on information from of the individual detection devices 7.

Moreover, in the above-mentioned respective embodiments, the support device 8 is used as a guide device for causing the car 3 to move along the corresponding car guide rail 2, but the support device 8 may instead be provided on the car 3 separately from the guide device. In this case, the support device 8 is disposed at a location, for instance, between a side portion of the car 3 and the guide rails 2, etc.

Further, in the above-mentioned respective embodiments, the objects to be detected such as the bolts or the like are detected by the proximity sensor 18, but anything, such as for example an optical sensor, an image sensor or the like, which is capable of detecting the objects to be detected can be used instead of the proximity sensor 18.

Furthermore, in the above-mentioned respective embodiments, the number of the acceleration sensor 19 is one, but a plurality of acceleration sensors can be used. In addition, in the above-mentioned respective embodiments, the acceleration sensor 19 is mounted on the support device 8, but the acceleration sensor 18 may be directly mounted on the car 3.

The invention claimed is:

1. A control apparatus for an elevator comprising:

a support device mounted on a car and including a rail holding member which is displaceable with respect to the car, the car moving up and down in a hoistway, and guided by a guide rail located in the hoistway, wherein the rail holding member includes a plurality of guide rollers;

a reference position detection device, mounted on the rail holding member, for detecting an object fixedly located in the hoistway, when the car is located at a reference position within the hoistway;

a position detection device, mounted on the rail holding member, for detecting position of the car in the hoistway, the position detection device including a plurality of continuous position detection parts, each continuous position detection part respectively detecting the position of the car, continuously, based on rotation of the guide rollers; and a control unit that controls operation of the elevator apparatus based on information received from the reference position detection device and the position detection device, wherein the control unit compares position information received from each of the continuous position detection parts to each other and detects no abnormality when no difference between the position information received exceeds a first difference threshold, compares continuous detection part calculated values, which are calculated based on the position information received from each of the continuous position detection parts, to determine the position of the car in the hoistway, with the reference position detected by the reference position detection device, when the reference position detection part detects the object, and replaces the position of the car in the hoistway determined from the continuous detection part calculated values with the reference position when difference between the positions determined from the continuous detection parts and the reference position detection device does not exceed a position threshold, and, thereafter, controls the operation of the elevator apparatus based on the position of the car as replaced.

2. The control apparatus for an elevator as set forth in claim 1, wherein the support device is a guide device for moving the car along the guide rail.

3. The control apparatus for an elevator as set forth in claim 1, wherein the control unit compares the continuous detection part calculated values to each other, and detects an abnormality when any difference between the continuous detection part calculated values exceeds a second difference threshold.

4. The control apparatus for an elevator as set forth in claim 1, wherein the object is selected from the group consisting of a bolt joining unit rails of the guide rail, a bracket supporting the guide rail, and a door sill of an elevator hall.

5. A control apparatus for an elevator comprising:

a support device mounted on a car and including a rail holding member which is displaceable with respect to the car, the car moving up and down in a hoistway, guided by a guide rail located in the hoistway;

a position detection device, mounted on the rail holding member holding the guide rail in the hoistway, for detecting position of the car in the hoistway;

an acceleration detection device for detecting acceleration of the car; and a control unit that controls operation of the elevator apparatus, wherein the control unit controls the operation of the elevator apparatus based on information from the position detection device and from the acceleration detection device.

6. A control apparatus for an elevator comprising:

a support device mounted on a car and including a rail holding member which is displaceable with respect to the car, the car moving up and down in a hoistway, guided by a guide rail located in the hoistway;

a position detection device, mounted on the rail holding member, for detecting position of the car in the hoistway;

a main rope break detection device for detecting breaking of a main rope from which the car hangs; and a control unit that controls operation of the elevator apparatus, wherein the control unit controls the operation of the elevator apparatus based on information received from the position detection device and from the main rope break detection device.

* * * * *